US006089313A

United States Patent [19]

Levy et al.

[11] Patent Number: 6,089,313

[45] Date of Patent: Jul. 18, 2000

[54] APPARATUS FOR EXCHANGING HEAT BETWEEN AT LEAST THREE FLUIDS

[75] Inventors: William Levy, Paris; Dominique Sabin, Herbeville, both of France

[73] Assignee: Packinox, Cedex, France

[21] Appl. No.: 09/214,827

[22] PCT Filed: Jul. 7, 1997

[86] PCT No.: PCT/FR97/01225

§ 371 Date: Mar. 31, 1999

§ 102(e) Date: Mar. 31, 1999

[87] PCT Pub. No.: WO98/03831

PCT Pub. Date: Jan. 29, 1998

[30] Foreign Application Priority Data

Jul. 16, 1996 [FR] France ..... 96 09115

[51] Int. Cl.[7] ..... F28D 7/00

[52] U.S. Cl. ..... 165/140; 165/81; 165/145; 165/166

[58] Field of Search ..... 165/140, 81, 82, 165/145, 166

[56] References Cited

U.S. PATENT DOCUMENTS

| | | | |
|---|---|---|---|
| 2,439,208 | 4/1948 | Gloyer | 165/166 X |
| 3,266,568 | 8/1966 | Butt et al. | 165/166 |
| 3,282,334 | 11/1966 | Stahlheber | 165/166 |
| 3,590,909 | 7/1971 | Butt | 165/166 X |
| 3,792,842 | 2/1974 | Nakako et al. | 165/166 X |
| 4,330,308 | 5/1982 | Grenier et al. | 165/140 X |
| 4,486,210 | 12/1984 | Gauthier | 165/140 X |
| 4,721,164 | 1/1988 | Woodward | 165/166 X |
| 5,324,452 | 6/1994 | Allam et al. | 165/166 X |
| 5,333,681 | 8/1994 | Jullien et al. | 165/82 |
| 5,755,280 | 5/1998 | Da Costa et al. | 165/140 |

FOREIGN PATENT DOCUMENTS

| | | | |
|---|---|---|---|
| 0 383 224 A2 | 8/1990 | European Pat. Off. . | |
| 2 131 791 | 11/1972 | France . | |
| 2 733 823 | 11/1996 | France . | |
| 2029783 | 12/1971 | Germany | 165/140 |

*Primary Examiner*—Leonard Leo
*Attorney, Agent, or Firm*—Pollock, Vande Sande & Amernick

[57] ABSTRACT

An apparatus for exchanging heat between at least three fluids includes an elongate sealed chamber having at least two separate plate cores arranged inside the sealed chamber and means for supporting each of the plate cores inside the scaled chamber. Each of the plate cores are provided with circuits for two separate fluids, fluid inlet and outlet means for the respective circuits of the plate cores, and connecting means enabling fluid circulation between the plate cores.

14 Claims, 5 Drawing Sheets

APPARATUS FOR EXCHANGING HEAT BETWEEN AT LEAST THREE FLUIDS

FIELD OF INVENTION

Figure 1:
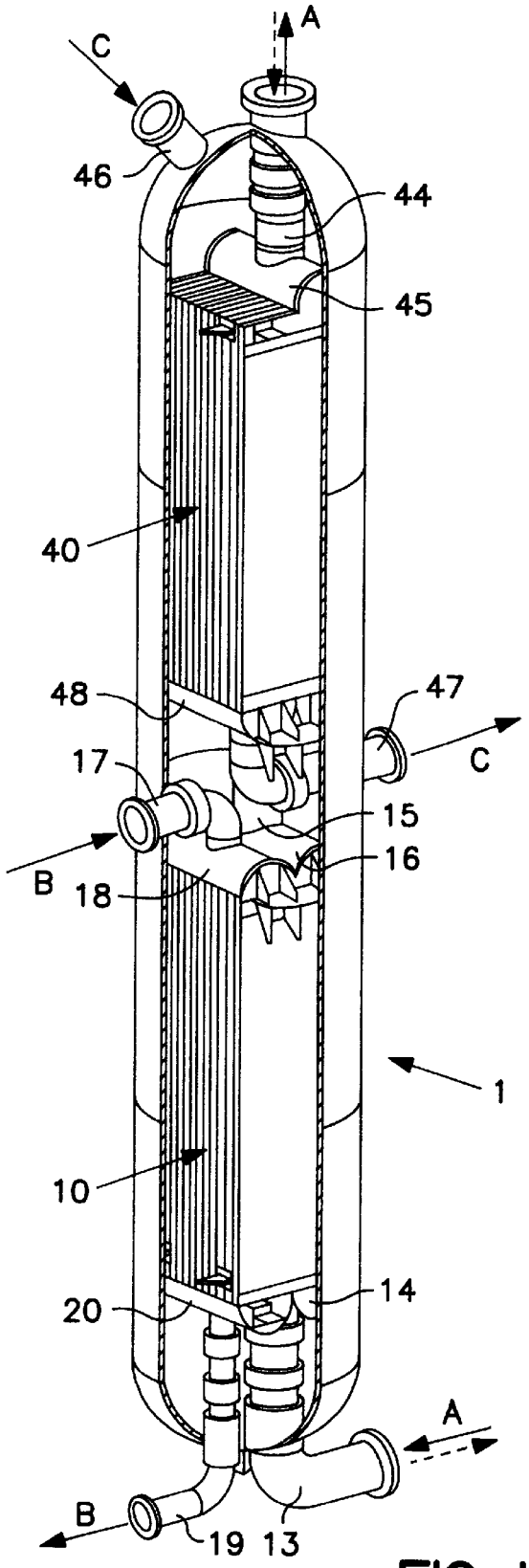

The present invention relates a heat-exchange installation used to cool or heat a first fluid by heat exchange with at least two other fluids.

BACKGROUND OF THE INVENTION

Heat-exchange installations comprise heat exchangers which are generally of two types.

The first type of heat exchanger comprises a bundle of U-shaped tubes or a bundle of straight tubes through which one of the fluids circulates.

However, this type of exchanger is of expensive design and the thermal efficiency is limited, given that the number of tubes depends on the space available which, in most instances, is restricted.

The second type of heat exchanger comprises a sealed vessel in which there is installed a bundle of plates arranged contiguously and parallel to each other.

The plates, which consist of thin sheets, usually made of stainless steel, have smooth-surfaced edges and a corrugated central region via which they are in contact with one another and via which they delimit channels that form circuits for the circulation of independent fluids.

This type of heat exchanger with bundles of plates operates with various fluids such as, for example, liquids or gases or two-phase mixtures.

With this plate-type exchanger, with the two liquids circulating through the respective circuits, there is heat exchange between these two fluids, and this heat exchange allows one of the fluids to be heated up and the other cooled, or vice versa.

For certain industrial applications, it is necessary to obtain a substantial temperature difference of the fluid to be heated or cooled between its entry into and exit from the plate-type exchanger.

This is why, in such an instance, several plate-type exchangers are arranged in sequence.

Each plate-type heat exchanger is made up of a sealed vessel in which there is arranged a plate bundle delimiting two circuits, one of which is intended for the main fluid that is to be heated or cooled.

These main circuits of the various plate bundles are interconnected by connecting pipes which pass through each vessel in a sealed way so as to allow the main fluid to circulate continuously through the various plate bundles.

As a result, the floor space required for this kind of installation is great and the cost of manufacturing and maintaining it is also high.

Furthermore, the connecting pipes between the various exchangers for transferring the main fluid between these exchangers constitute regions where there are needless and parasitic pressure drops and regions where heat is lost, and this reduces the efficiency of the heat-exchange installation.

SUMMARY OF THE INVENTION

The object of the invention is to avoid the aforementioned drawbacks by proposing a compact heat-exchange installation which makes it possible to reduce the pressure drops and the weight and bulk of the installation and to increase its efficiency.

The subject of the invention is therefore an installation for heat exchange between at least three fluids, and it comprises:

a sealed vessel of elongate shape, at least two separate plate bundles arranged inside the sealed vessel and each formed of a stack of metal heat-exchange plates with corrugations, and delimiting between them two circuits for the circulation of two independent fluids, inlet means for introducing a first fluid into the corresponding circuit of the first plate bundle, means for connecting one circuit of the first plate bundle with one circuit of the second plate bundle to allow the first fluid to circulate between the two plate bundles, outlet means for letting the first fluid out of the corresponding circuit of the second plate bundle, inlet means and outlet means for introducing a second fluid into and letting this fluid out of the corresponding circuit of the first plate bundle, inlet means and outlet means for introducing a third fluid into and letting this fluid out of the corresponding circuit of the second plate bundle, and means of holding each plate bundle in the sealed vessel.

According to other features of the invention:

the inlet means for introducing the first fluid are formed by a nozzle passing through the sealed vessel and connected to a manifold arranged on the inlet of the corresponding circuit of the first plate bundle, the means of connection for circulating the first fluid between the two plate bundles are formed by a nozzle connected by one of its ends to a manifold arranged on the outlet of the corresponding circuit of the first plate bundle, and by its other end to a manifold arranged on the inlet of the corresponding circuit of the second plate bundle, the outlet means for letting out the first fluid are formed by a nozzle passing through the sealed vessel and connected to a manifold arranged on the outlet of the corresponding circuit of the second plate bundle, the inlet means for introducing the second fluid into the first plate bundle are formed by a nozzle passing through the sealed vessel and connected to a manifold arranged on the inlet of the corresponding circut of the first plate bundle, the outlet means for letting the second fluid out of the first plate bundle are formed by a nozzle passing through the sealed vessel and connected to a manifold arranged on the outlet of the corresponding circuit of the first plate bundle, the inlets of the circuits for circulating the first fluid and the second fluid through the first plate bundle are located at the same end of the said first plate bundle for co-current circulation of the said fluids, the inlets of the circuits for circulating the first fluid and the second fluid through the first plate bundle are each located at opposite ends of the first plate bundle for counter-current circulation of the fluids, the inlet means for introducing the third fluid are formed by a nozzle opening into the sealed vessel and communicating with the inlet of the corresponding circuit of the second plate bundle, the outlet means for letting out the third fluid are formed by a nozzle passing through the sealed vessel and connected to a manifold arranged on the outlet of the corresponding circuit of the second plate bundle, the inlets of the circuits for circulating the first fluid and the third fluid through the second plate bundle are located at the same end of the second plate bundle for co-current circulation of the fluids, the inlets of the circuits for circulating the first fluid and the third fluid through the second plate bundle are each located at opposite ends of the second plate bundle for counter-current circulation of the fluids, the means of holding the first plate bundle are arranged level with the outlet for the first fluid from the first plate bundle and comprise, two mounting plates essentially in the shape of half-discs, connected to the corresponding manifolds, and, two mounting plates essentially in the shape of half-discs, connected to the internal wall of the sealed vessel, the mounting plates bearing on each other and allowing the first plate bundle to dilate towards the inlet for the first fluid, the means of holding the second plate bundle are arranged level with the inlet for the first fluid into the second plate bundle and comprise, two mounting plates essentially in the shape of half-discs, connected to the corresponding manifolds, and, two mounting plates essentially in the shape of half-discs, connected to the internal wall of the sealed vessel, the mounting plates bearing on each other and allowing the second plate bundle to dilate towards the outlet for the first fluid.

BREIF DESCRIPTION OF THE DRAWINGS

Figure 2:
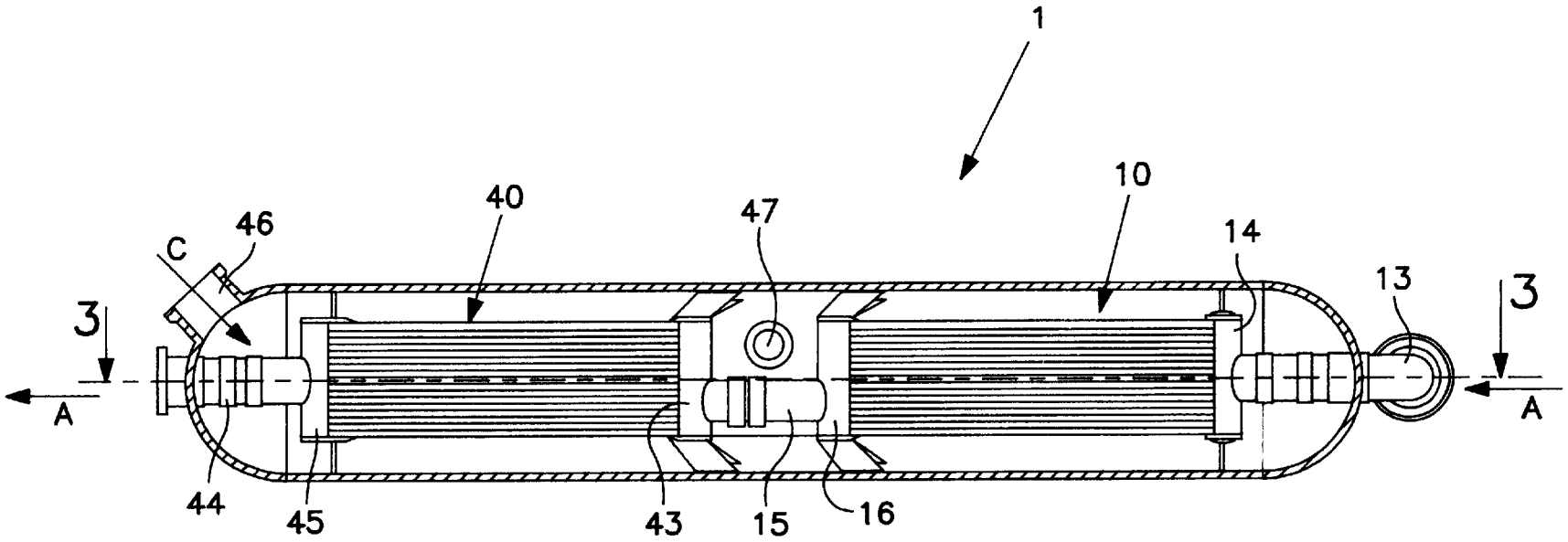
Figure 3:
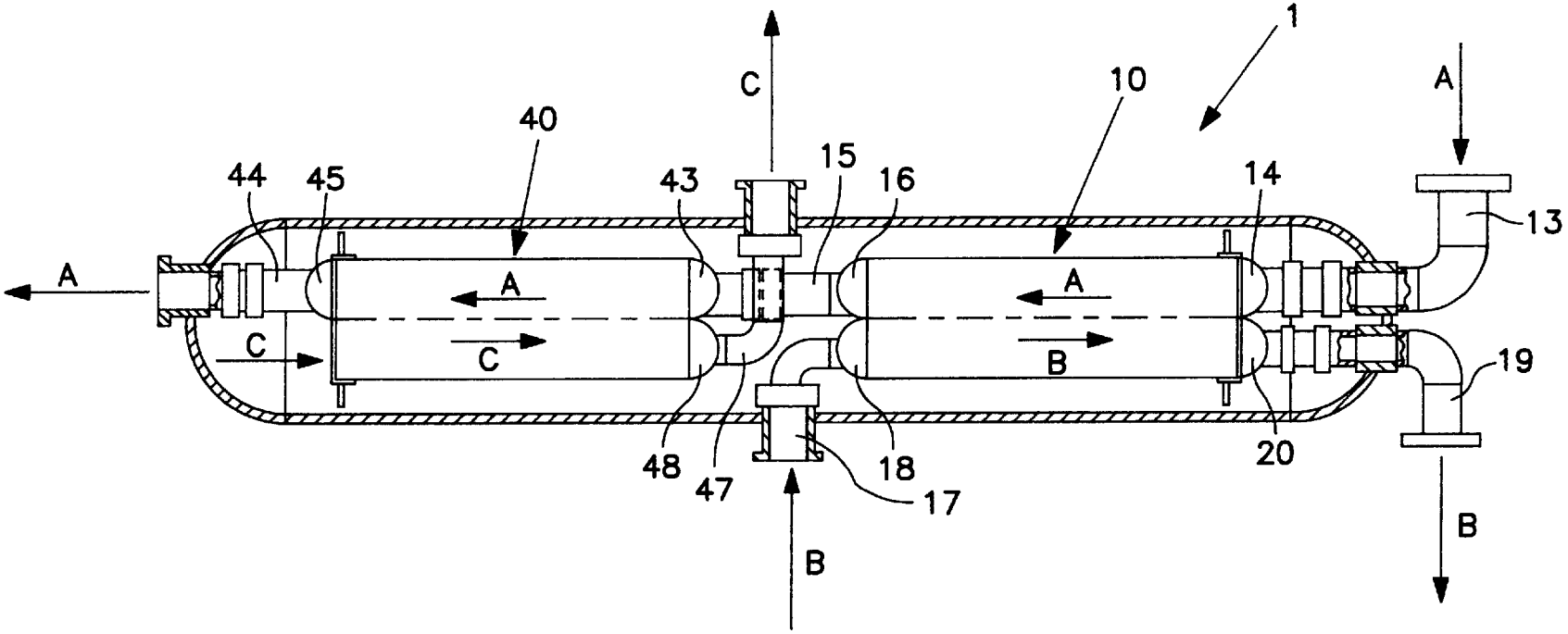
Figure 4:
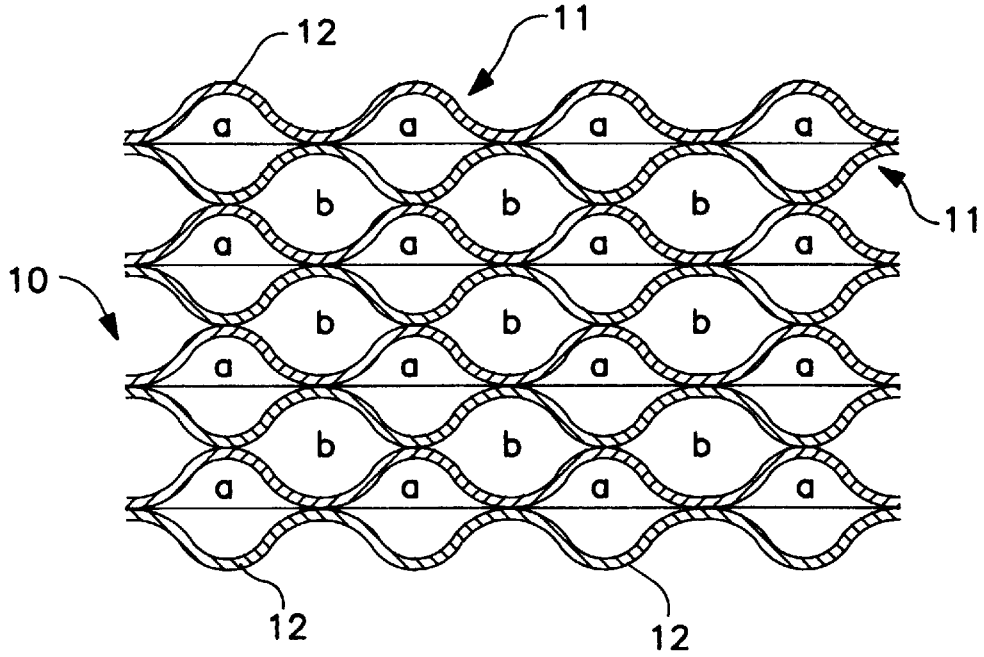
Figure 5:
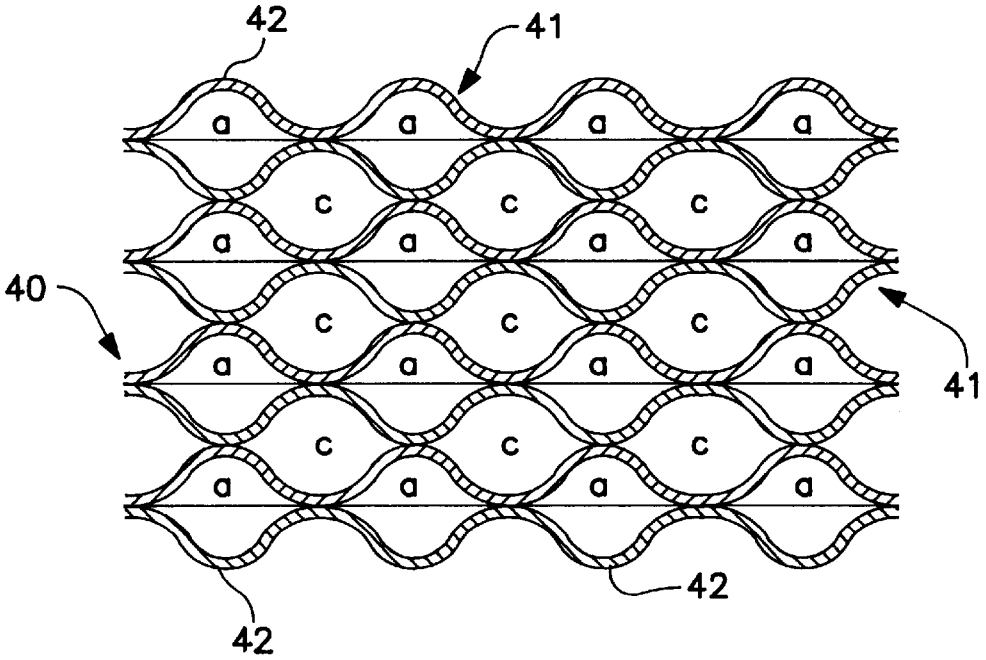
Figure 6:
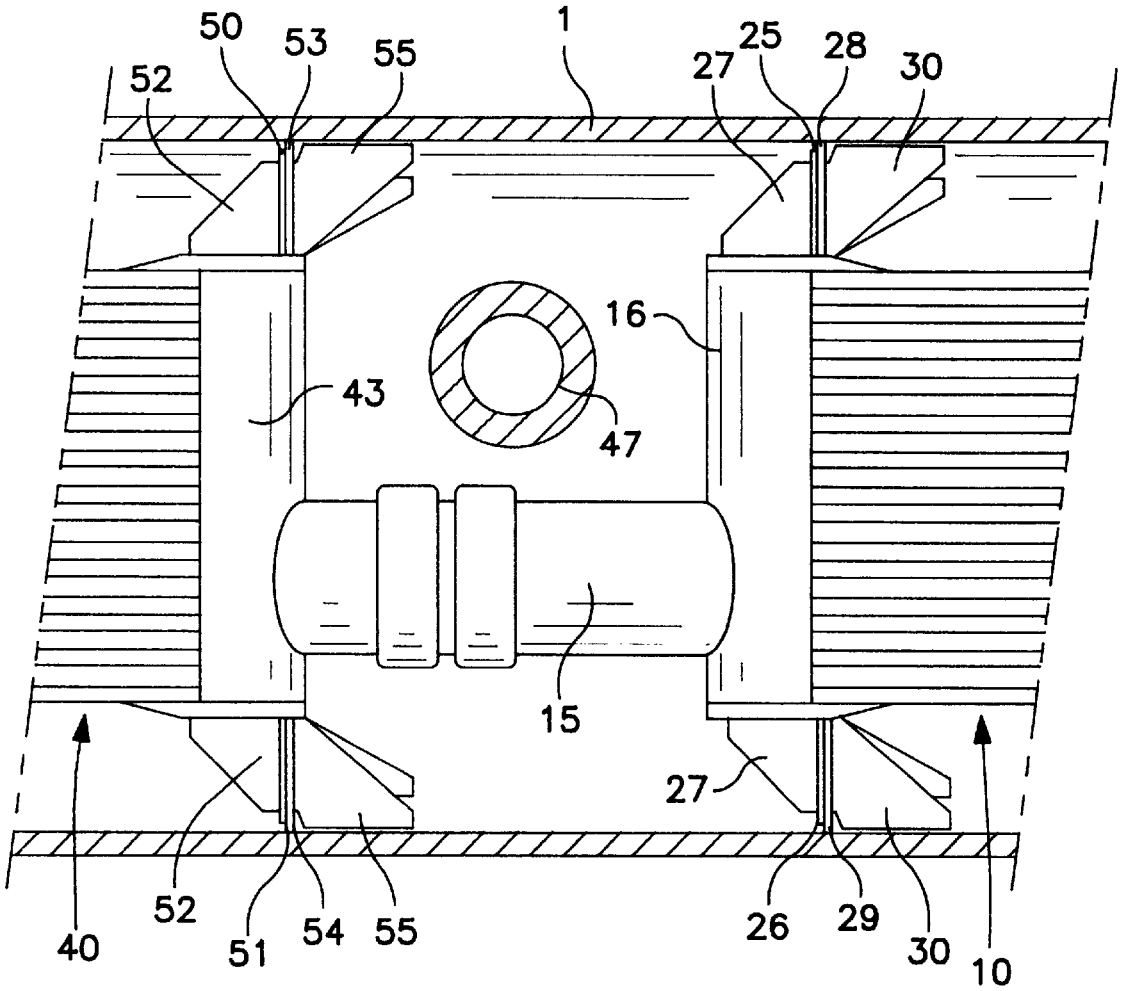

The features and advantages of the invention will become clear through the description which will follow, given merely by way of example and with reference to the appended drawings, in which:

FIG. 1 is a schematic perspective view, with partly cut away of a heat-exchange installation according to the invention, FIG. 2 is a schematic view in longitudinal section of the heat-exchange installation according to the invention, FIG. 3 is a section view along line 3—3 of FIG. 2, FIG. 4 is a schematic view in cross section of a portion of the first plate bundle of the heat-exchange installation according to the invention, FIG. 5 is a schematic view in cross section of a portion of the second plate bundle of the heat-exchange installation according to the invention, and FIG. 6 is a view in longitudinal section and on a larger scale showing the means of holding the plate bundle in the sealed vessel.

DESCRIPTION OF THE INVENTIONS

FIGS. 1 to 3 deopct an installation intended to perform heat exchange between a first fluid A consisting of a liquid or a gas or a two-phase mixture and at least two fluids B and C each consisting of a liquid or of a gas or of a two-phase mixture.

This heat-exchange installation is intended, for example, to cool the first fluid A using fluids B and C or to heat up this first fluid A.

In the embodiment depicted in the drawing figures, the first fluid A is cooled by two fluids B and C, respectively.

However, this first fluid A could be cooled by more than two other fluids.

The heat-exchange installation depicted in FIGS. 1 to 3 comprises a sealed vessel 1 of elongate shape and, for example, of circular cross section.

This sealed vessel 1 is equipped with support members (not shown), intended to rest on a receiving surface, and this sealed vessel 1 is preferably arranged vertically.

Arranged inside the sealed vessel 1 are, a first plate bundle 10 and a second plate bundle 40.

The plate bundles 10 and 40 are separated from each other.

The first plate bundle 10 has a parallelepipedal overall shape and constitutes the exchange surface needed for heat transfer between the fluids A and B.

As depicted in FIG. 4, the first plate bundle 10 is formed by a stack of thin metal plates 11, for example made of stainless steel, with corrugations 12.

The plates 11 of the plate bundle 10 are parallel to one another and are in contact with each other at the corrugations 12 so as to delimit channels forming circuits for the circulation of independent fluids.

These plates 11 form between them a first longitudinal circuit a for the first fluid A, extending over the entire length of the plate bundle 10, and a second longitudinal circuit b for the second fluid B, also extending over the entire length of the plate bundle 10.

The second plate bundle 40 has a parallelepipedal overall shape and constitutes the exchange surface needed for heat transfer between the fluids A and C.

As depicted in FIG. 5, this second plate bundle 40 is formed by a stack of thin metal plates 41, for example made of stainless steel, with corrugations 42.

The plates 41 of the plate bundle 40 are parallel to one another and are in contact with each other at the corrugations 42 so as to delimit channels forming circuits for the circulation of independent fluids.

These plates 41 form between them a first longitudinal circuit a for the first fluid A, extending over the entire length of the plate bundle 40, and a second longitudinal circuit c for the third fluid C, also extending over the entire length of the plate bundle 40.

The heat-exchange installation also comprises:

inlet means for introducing the first fluid A into the circuit a of the first plate bundle 10, means for connecting the circuit a of the first plate bundle 10 with the circuit a of the second plate bundle 40 to allow the first fluid A to circulate between plate bundles 10 and 40, outlet means for letting the first fluid A out of the circuit a of the second plate bundle 40, inlet and outlet means for introducing the second fluid B into and letting this fluid out of the corresponding circuit b of the first plate bundle 10, inlet and outlet means for introducing the third fluid C into and letting this fluid out of the corresponding circuit c of the second plate bundle 40, and means of holding each plate bundle 10 and 40 in sealed vessel 1.

As depicted in FIGS. 1 to 3, inlet means for introducing the first fluid A into the circuit a of the first plate bundle 10 are formed by a nozzle 13 passing in a sealed way through the vessel 1 and connected to a manifold 14 arranged on the inlet of the circuit a of the first place bundle 10.

The means of connection for circulating the first fluid A between the two plate bundles 10 and 40 are formed by a nozzle 15 connected by one of its ends to a manifold 16 arranged on the outlet of the circuit a of the first plate bundle 10 and by its other end to a manifold 43 arranged on the inlet of the circuit a of the second plate bundle 40.

The outlet means for letting the first fluid A out of the second plate bundle 40 are formed by a nozzle 44 passing in a sealed manner through the vessel 1 and connected to a manifold 45 arranged on the outlet of the circuit a of the second plate bundle 40.

Inlet means for introducing the second fluid B into the first plate bundle 10 are formed by a nozzle 17 passing in a sealed manner through the vessel 1 and connected to a manifold 18 arranged on the inlet of the circuit b of the first plate bundle 10.

The outlet means for letting the second fluid B out of the first plate bundle 10 are formed by a nozzle 19 passing in a sealed manner through the vessel 1 and connected to a manifold 20 arranged on the outlet of the circuit b of the first plate bundle 10.

In the embodiment depicted in the drawings, the circulation of fluids A and B through the first plate bundle 10 is counter-current, and consequently the inlet for fluid A and the outlet for fluid B are located at the same end of the plate bundle 10, and the outlet for fluid A and the inlet for fluid B are located at the opposite end of the said plate bundle 10.

In an alternative embodiment, the circulation of fluids A and B through the first plate bundle 10 may be co-current and in this case, the inlets for the fluids A and B are located at the same end of the first plate bundle 10.

In this case the outlets for fluids A and B are also located at the sure end of the first plate bundle 10.

The inlet means for introducing the third fluid C into the second plate bundle 40 are formed by a nozzle 46 opening into the sealed vessel 1 and communicating with the inlet of the circuit c of the second plate bundle 40.

The third fluid C therefore circulates through the circuit c of the second plate bundle 40 and is also diffused into the sealed vessel 1 so as to pressurize plate bundles 10 and 40.

The outlet means for letting the third fluid C out of the second plate bundle 40 are formed by a nozzle 47 passing in a sealed manner through the vessel 1 and connected to a manifold 48 arranged on the outlet of the circuit c of the second plate bundle 40.

In the embodiment depicted in the drawings, the circulation of fluids A and C through the second plate bundle 40 is counter-current, which means that the inlets for fluids A and C are located at opposite ends of the second plate bundle 40.

In an alternative form, the circulation of fluids A and C through the second plate bundle 40 may be co-current, and, in this case, the inlets for fluids A and C are located at the same end of the second plate bundle 40.

The means of holding the plate bundles 10 and 40 inside the sealed vessel 1 will now be described with reference to FIG. 6.

As depicted in this figure, the means of holding the first plate bundle 10 are arranged level with the outlet for fluid A from this plate bundle 10, and the means of holding the second plate bundle 40 are arranged level with the inlet for fluid A into this plate bundle 40.

The means of holding the first plate bundle 10 comprise two mounting plates, 25 and 26 respectively, which are essentially in the shape of half-discs.

These mounting plates 25 and 26 have stiffening braces 27 welded therein.

The mounting plates 25 and 26 and the braces 27 are connected to the manifolds 16 and 18, for example by welding.

The means of holding the first plate bundle 10 also comprise two mounting plates 28 and 29, essentially in the shape of half-discs.

The mounting plates 28 and 29 also have stiffening braces 30 fixed to them plates by welding.

The mounting plates 28 and 29 are fixed via their outer edges to the internal wall of the sealed vessel 1, for example by welding.

Thus, the mounting plates 25 and 26 support the first plate bundle 10 and rest on the mounting plates 28 and 29 secured to the sealed vessel 1, which allows the first plate bundle 10 to dilate towards the inlet for the first fluid A, i.e., towards the end of the sealed vessel 1.

The means of holding the second plate bundle 40 comprise two mounting plates, 50 and 51 respectively, essentially in the shape of half-discs and fitted with stiffening braces 52.

The mounting plates 50 and 51, and the braces 52, are fixed to the manifolds 43 and 48, for example by welding.

Furthermore, the means of holding the second plate bundle 40 also comprise two mounting plates, 53 and 54 respectively, essentially in the shape of half-discs and fitted with stiffening braces 55 fixed to the mounting plates 53 and 54 by welding.

These mounting plates 53 and 54 are fixed via their outer edges to the internal wall of the vessel 1, for example by welding.

Thus, the mounting plates 50 and 51 secured to the second plate bundle 40 rest on the mounting plates 53 and 54 secured to the sealed vessel 1, which allows the second plate bundle 40 to dilate towards the outlet for the first fluid A of this second plate bundle 40, i.e. towards the end of the sealed vessel 1.

By virtue of this arrangement, as the heat-exchange installation operates, the plate bundles 10 and 40 can dilate mainly in two opposite directions, thus reducing any stress on the nozzle 15 making the connection between these two plate bundles 10 and 40.

As the heat-exchange installation operates, the first fluid A that is to be heated up or cooled down is introduced through the nozzle 13 and through the manifold 14 into the circuit a of the first plate bundle 10.

This fluid A circulates through the circuit +uns a+ee along the entire length of the first plate bundle 10.

The second fluid B is introduced via the nozzle 17 and the manifold 18 into the circuit +uns b+ee of the first plate bundle 10.

This fluid B circulates along the entire length of the first plate bundle 10 and exits the heat-exchange installation through the manifold 20 and the outlet nozzle 19.

As the fluids A and B circulate through the first plate bundle 10, there is an exchange of heat between these fluids, and this allows the first fluid A to be cooled or heated.

This first fluid A then enters the circuit +uns a+ee of the second plate bundle 40, passing through the manifold 16, the connecting nozzle 15 and the manifold 43, and circulates the entire length of the second plate bundle 40.

The third fluid C is introduced into the circuit +uns c+ee of the second plate bundle 40 via the inlet nozzle 46 and circulates the entire length of this second plate bundle 40.

The third fluid C exits the circuit c of the second plate bundle 40 via the manifold 48 and the outlet nozzle 47.

As the fluids A and C pass through the second plate bundle 40, there is an exchange of heat between these fluids A and C, and this allows the fluid A to be cooled or heated.

The fluid A thus cooled or heated exits the heat-exchange installation through the manifold 45 and the nozzle 44.

The casing that constitutes the sealed vessel 1 provides sealing against the atmosphere and allows the plate bundles 10 and 40 to be pressurized externally by the fluid C introduced into the sealed vessel 1.

According to an alternative embodiment, several plate bundles may be arranged in sequence in the sealed vessel.

The heat-exchange installation according to the invention makes it possible to obtain a significant differential between the inlet temperature of the main fluid and its outlet temperature, and therefore to increase efficiency while at the same time reducing the bulkiness of the installation.

What is claimed is:

1. An installation for heat exchange between at least three fluids A, B and C, said installation comprising:

(a) a sealed vessel (1) of elongate shape;

(b) at least two separate plate bundles (10; 40) arranged inside said sealed vessel (1) and each formed of a stack of metal heat-exchange plates (11; 41) having corrugations (12; 42) and delimiting between them two circuits for circulation of two independent fluids;

(c) inlet means (13, 14) for introducing a first fluid A into a corresponding circuit of a first of said plate bundles (1);

(d) means (15, 16, 43) for connecting said first plate bundle (10) with one circuit of a second of said plate bundles (40) to allow said first fluid A to circulate between said first and second plate bundles (10; 40);

(e) outlet means (44, 45) for letting said first fluid A out of the corresponding circuit of said second plate bundle (40);

(f) inlet means (17, 18) and outlet means (19, 20) for introducing a second fluid B into and letting said second fluid B out of the corresponding circuit of said first plate bundle (10);

(g) inlet means (46) and outlet means (47, 48) for introducing a third fluid C into and letting said third fluid C out of the corresponding circuit of said second plate bundle (40); and (h) means for holding each plate bundle (10; 40) in said sealed vessel (1).

2. The installation according to claim 1, wherein the inlet means for introducing said first fluid (A) are formed by a nozzle (13) passing through the sealed vessel (1) and connected to a manifold (14) arranged on an inet of the corresponding circuit of said first plate bundle (10).

3. The installation according to claim 2, wherein respective inlets of the circuits for circulating said first fluid A and said second fluid B through said first plate bundle (10) are located at the same end of said first plate bundle (10) for co-current circulation of said fluids.

4. The installation according to claim 2, wherein respective inlets of the circuits for circulating said first fluid A and said second fluid B through said first plate bundle (10) are each located at opposite ends of said first plate bundle (10) for counter-current circulation of said fluids.

5. The installation according to claim 1, wherein the means of connection for circulating said first fluid A between said first and second plate bundles (10; 40) are formed by a nozzle (15) connected by one of its ends to a manifold (16) arranged on an outlet of the corresponding circuit of said first plate bundle (10) and by its other end to a manifold (43) arranged on an inlet of the corresponding circuit of said second plate bundle (40).

6. The installation according to claim 1, wherein the outlet means for letting out said first fluid A are formed by an nozzle (44) passing through the sealed vessel (1) and connected to a manifold (45) arranged on an outlet of the corresponding circuit of said second plate bundle (40).

7. The installation according to claim 6, wherein the inlet means of the circuits for circulating said first fluid A and said third fluid C through said second plate bundle (40) are located at the same end of said second plate bundle (40) for co-current circulaton of said fluids.

8. The installation according to claim 6, wherein the inlet means of the circuits for circulating said first fluid A and said third fluid C through said second plate bundle (40) are each located at opposite ends of said second plate bundle (40) for counter-current circulation of the fluids. characterized in that respective inlets of the circuits for circulating the first fluid A and the second fluid B through the first plate bundle (10) each lie at opposite ends of the first plate bundle (10) for counter-current circulation of the fluids.

9. The installation according to claim 1, wherein the inlet means for introducing said second fluid B into the said first plate bundle (10) are formed by a nozzle (17) passing through the sealed vessel (1) and connected to a manifold (18) arranged on an inlet of the corresponding circuit of said first plate bundle (10).

10. The installation according to claim 1, wherein the outlet means for letting said second fluid B out of said first plate bundle (10) are formed by a nozzle (19) passing through the sealed vessel (1) and connected to a manifold (20) arranged on an outlet of the corresponding circuit of said first plate bundle (10).

11. The installation according to claim 1, wherein the inlet means for introducing said third fluid C are formed by a nozzle (46) opening into the sealed vessel (1) and communicating with an inlet of the corresponding circuit of said second plate bundle (40).

12. The installation according to claim 1, wherein the outlet means for letting out said third fluid C are formed by a nozzle (47) passing through the sealed vessel (1) and connected to a manifold (48) arranged on an outlet of the corresonding circuit of said second plate bundle (40).

13. The installation according to claim 1, wherein the means of holding said first plate bundle (10) are arranged level with the outlet means for said first A from said first plate bundle (10) and comprise two mounting plates (25, 26) essentially in the shape of half-discs, connected to the corresponding manifolds (16, 18), and two mounting plates (28, 29) essentially in the shape of half-discs, connected to the internal wall of the sealed vessel (1), said mounting plates (25, 26; 28, 29) bearing on each other and allowing said first plate bundle (10) to dilate towards the inlet means for said first fluid A.

14. The installation according to claim 1, wherein the means for holding said second plate bundle (40) are arranged level with the inlet means for said first fluid A into said second plate bundle (40) and comprise two mounting plates (50, 51) essentially in the shape of half-discs, connected to the corresponding manifolds (43, 48), and two mounting plates (53, 54) essentially in the shape of half-discs, connected to the internal wall of the sealed vessel (1), said mounting plates (50, 51; 53, 54) bearing on each other and allowing said second plate bundle (40) to dilate towards the outlet means for said first fluid (A). characterized in that the means of holding the second plate bundle (40) are arranged level with the inlet means for the first fluid A into the plate bundle (40) and comprise, on the one hand, two mounting plates (50, 51) essentially in the shape of half-discs, connected to the corresponding manifolds (43, 48) and, on the other hand, two mounting plates (53, 54) essentially in the shape of half-discs, connected to the internal wall of the sealed vessel (1), the mounting plates (50, 51; 53, 54) bearing on each other and allowing the second plate bundle (40) to dilate towards the outlet means for the first fluid (A).

* * * * *

UNITED STATES PATENT AND TRADEMARK OFFICE

CERTIFICATE OF CORRECTION

PATENT NO. : 6,089,313
DATED : July 18, 2000
INVENTOR(S) : William Levy, Dominique Sabin It is certified that error appears in the above-identified patent and that said Letters Patent is hereby corrected as shown below:

Title page
Foreign Application Priority Data [30], change "Jul. 16, 1996" to --Jul. 19, 1996--.

Claim 2, line 4, change "inet" to --inlet--.

Claim 7, line 5, change "circulaton" to --circulation--.

Claim 12, line 5, change "corresonding" to --corresponding--.

Claim 13, line 3, after "first" insert --fluid--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*